United States Patent [19]

Muncheryan

[11] 4,203,098

[45] May 13, 1980

[54] DEVICE FOR PREVENTING DOZING WHILE DRIVING A CAR

[76] Inventor: Hrand M. Muncheryan, 1735 N. Morningside St., Orange, Calif. 92667

[21] Appl. No.: 943,249

[22] Filed: Sep. 18, 1978

[51] Int. Cl.[2] ..... G08B 21/00

[52] U.S. Cl. ..... 340/575; 340/407; 340/576; 128/33; 128/36

[58] Field of Search ..... 340/84, 87, 573, 575, 340/407, 576; 179/1 AA; 128/33, 36

[56] References Cited

U.S. PATENT DOCUMENTS

| | | | |
|---|---|---|---|
| 2,937,641 | 5/1960 | Oetinger | 128/33 |
| 3,464,405 | 9/1969 | Kallus | 128/36 |
| 3,580,245 | 5/1971 | Dill | 128/36 |
| 3,678,923 | 7/1972 | Oetinger | 128/33 |
| 3,911,425 | 10/1975 | Muncheryan | 340/573 |
| 3,947,815 | 3/1976 | Muncheryan | 340/575 |
| 3,955,222 | 5/1976 | Pater | 128/33 |
| 3,991,751 | 11/1976 | O'Rourke | 128/36 |

*Primary Examiner*—Gareth D. Shaw
*Assistant Examiner*—Joel Miller

[57] ABSTRACT

A device for preventing a car driver from dozing during a long distance driving to avoid an accident is described. The device comprises two separate parts electrically connected together by means of an electric cord. One of said parts comprises a housing attachable to the dashboard (instrument panel) of an automobile and contains therein an electric circuit energized by a battery current for producing pulsative signals which are transmitted to the second part mounted on the upwardly projecting back of a driver's seat for physical contact with the driver's back and to transmit said pulsative signals to the driver to keep him awake while driving a car or a truck. Said electric circuit further contains therein a branch circuit to furnish current to said second part which then produces stimuli that cause relaxation in the tired muscles of the driver in contact with said second part.

14 Claims, 9 Drawing Figures

DEVICE FOR PREVENTING DOZING WHILE DRIVING A CAR

The present invention is generally related to a device for keeping a car driver awake during a long-distance travel and is particularly concerned with a device which prevents the driver from dozing while he is driving, and relaxes his tired muscles when he has stopped to rest.

BACKGROUND OF THE INVENTION

At the present time, no standard method or device is being used on either passenger cars or trucks to prevent the driver from dozing due to tiredness as a result of driving. Roads have been constructed with parallel grooves or protrusions which may shake the driver passing over them to keep him awake and alert to road hazards. This applicant has also developed and patented a device for this particular purose, described and claimed in a U.S. Pat. No. 3,947,815. The patented device comprises a golfer's cap containing an alarm means energized by an electric battery and operable by a gravity-actuated switch means when the driver's head tilts when he is tired and feels drowsy. While it is experimentally found that when a driver begins to doze during driving, in most of such cases his head tilts forward to actuate the patented cap device; however, there are times when the driver dozes or falls into a drowsy state without his head being tilted forward and, surprisingly, he may doze at times without even closing his eyes. Such a situtation does not ensure the driver's safety at all times that he will be kept awake or awakened by the alarm when he experiences a torpid physical state.

To overcome these shortcomings of the existing methods of sustaining a car driver awake and mentally alert at all times, the present invention imparts an absolute safety measure to the driver using the device. While driving the car, if the driver feels drowsy he actuates manually a switch on the device to operate the device indefinitely until he is ready to turn it off. With this novel and effective method, the driver is kept awake at all times by the awakening stimuli transmitted to him by the awakening part of the device disposed in the back of his seat and in contact with his back. Since the spinal cord in the spinal column is the seat of the nervous system controlling the motive function of the human body comprising the arms and the legs, the awakening stimuli from the device disseminate from the nerve trunk in the spinal cord into the control function of the nervous system and thereby to sustain the brain function alert and the arms and the legs responsive to the brain control signals. Thus, by eliminating the tendency to doze, the driver's driving safety is ensured by the best possible safety measure.

Even though the driver is kept awake and alert using the present device during his travel, his body muscles may get tired because of continued driving. In such an event, he may stop his car at a secure area of the roadside and turn off the awakening or alerting section of the device and turn on, by means of the double-throw switch means, the relaxation-producing section of the electric circuit within the housing that is attached to the dashboard. This action causes a continued vibration to be produced in the part-two module attached to the seat back. The intensity of the vibration to suit the driver can be controlled by means of the current-intensity control means disposed on the housing attached to the dashboard. Thus, it is readily seen that the novel device aids the driver in a double function, by sustaining him awake and alert while driving and by relaxing and soothing his active muscles that may become tired and achy as a result of driving and sitting in a constant position. A further advantage of the present invention resides in the fact that the module which produces awakening or relaxation in the driver can be made either as a solid one-piece structure or in a two-piece structure. In the latter case, the portion of the module that is in contact with the back of the driver is a separate structure from the vibrating or pulsating part that contains the electrical mechanism for producing the alerting stimuli. In such an event, the vibrating or pulsating part of the module is shaped into a fusiform wand and is insertable into the hollow tubular portion of the module that is mounted between the seat back and the headrest above the seat back, and it can be removed from the module unit and used as a massager to soothe any part of the driver's body as he desires.

SUMMARY OF THE INVENTION

The present invention generally comprises two units, in which one unit contains the electrical circuit which puts out a current of variable intensity and of constant intermittence, and transmits the current to the second unit or alerting module. The latter unit is fastened to the back of a car seat and produces either an undulatory motion or pulsative undulations, which are transmitted to the driver of the car to respectively relax his tired muscles due to driving after he stops his car for resting or to keep him mentally alert while driving.

A principal object of the invention is to provide a simple and lowcost device that can be easily attached to the dashboard of any motor vehicle, such as a passenger car or truck, without the use of any mechanical tools, and receives current from the battery of the vehicle or from a dry-cell battery, to produce stimuli which can be effectively transmitted by said device to the driver during his travel a long distance, to sustain his mental faculties alert so that he can concentrate on his driving and use great care to avoid accident due to tiredness or due to tendency to doze.

To accomplish the abovestated purpose, one object of the invention is to provide a device which is small, compact, and easily installable on a car's dashboard (instrument panel) or on any other part of the car readily accessible to the driver, said device being provided therein with an electric circuit energized from a battery current output which is transformable into a mechanical motion for transmission to the driver of the vehicle to keep him mentally alert at all times while driving.

Another object of the invention is the provision of an awakening unit or module containing therein a rotary means to produce undulatory motion in said module, which is adapted to be mounted on the back of the driver's seat and having an extension therefrom to project from the front of the seat for abutment with the back of the driver and to transmit thereto said undulatory motion.

A further object of the invention is the provision of a means in said electric circuit which is adapted to manual variation of the intensity of the electric current and thereby the alerting stimuli to suit the driver's requirement.

A still further object of the invention is the provision of a housing to enclose said electric circuit and is adapted to be fastened to the dashboard (instrument panel) of an automobile by an adhesive means located on the bottom wall thereof facing the dashboard; said housing having a plurality of electric outlets, one of which is adapted to transmit current to the alerting module through an electric cord pluggable into said outlet for keeping the driver awake, and the other outlet being adapted to transmit a current to a light signal displaying the word HELP thereon, when the driver has a car or physical trouble.

Another object of the invention is to provide an elongated strip of springy metal curved at one end thereof and adapted to be mounted on the back of a car driver's seat and having a flat extension therefrom for making contact with the back of the driver; a cylindrical unit provided with a rotary means therin and adapted to snugly fit or permanently be fastened to the curved end of said strip of springy metal and having an electric cord with a plug for insertion into one of said plurality of outlets in said housing to receive energizing current therefrom.

A further object of the invention is the provision of a fusiform wand containing therein means for producing undulatory motion in said wand when it receives a current from the circuit in said housing through an electric cord connected to said means for producing undulatory motion; said wand is interchangeable with said cylindrical unit in the curved portion of the elongated strip of springy metal to function the same as said cylindrical unit described above, and when said wand is removed from the curved portion of the springy metal unit it can be used as a device for soothing the tired and achy parts of the driver's body.

Other objects and advantages of the invention will become more apparent from the detailed specification taken in conjuction with the accompanying drawings, in which.

DETAILED DESCRIPTION OF THE INVENTION

Figure 1:
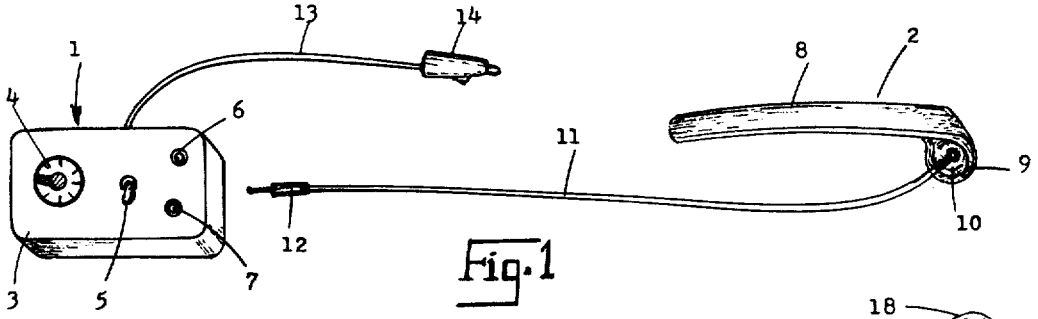
FIG. 1 is the perspective view of the complete device.
Figure 3:
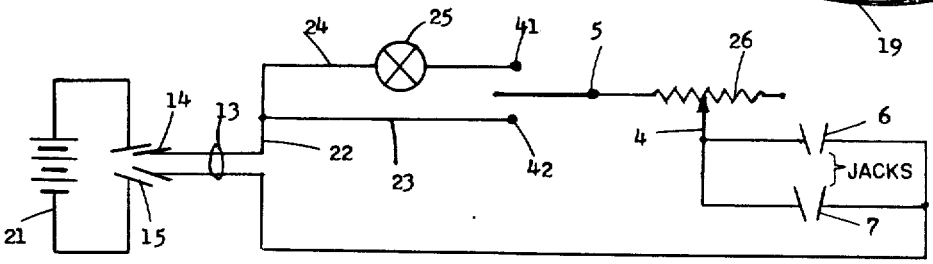
FIG. 3 is the schematic circuit diagram of the electric circuit for producing a variable current output.

Referring to the drawing shown in FIG. 1, numeral 1 designates, for convenience of identification, unit-one, and numeral 2 designates unit-two. The unit-one comprises a housing 3, with an electrical circuit therein, and having in the upper wall thereof a current-varying device 4, a double-throw switch 5 with a neutral or off position when the switch toggle or lever is positioned vertically to the housing top, and two current outlets or jacks 6 and 7, which are connected in parallel in the circuit within the housing and are shown in FIG. 3. The unit-two comprises a flat and elongated metal strip or flap 8 made of spring metal, such as half-hard aluminum or partially hardened steel, and having a width of, for example, 2 to 3 inches, length of 7 to 10 inches, and a thickness of 1/16 inch or less. The metal strip 8 is curved at one end 9 and the free end of the curved section is welded, soldered, or fastened by screws to the flat portion of the strip, forming a tubular structure at the curved end to accept a cylindrical plug 10 with an electric cord 11 projecting therefrom and terminating in a telephone-plug-type member 12, which, in operation of the device, plugs into the jack 6 or jack 7. Since the jacks 6 and 7 are electrically connected in parallel in the curcuit it does not matter whether the plug 12 is inserted into one or the other jack.

Figure 2:
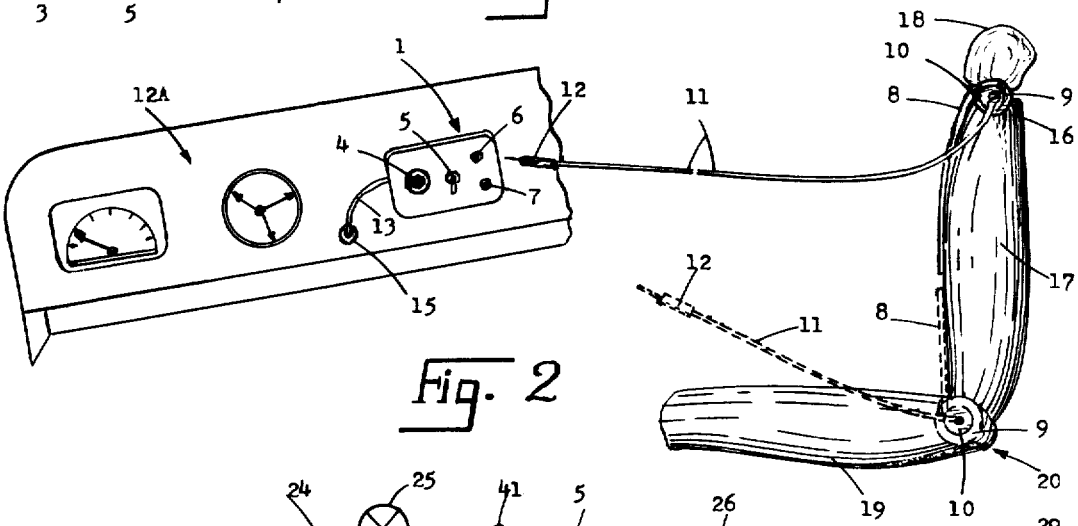
FIG. 2 shows the manner of application of the invention.

In FIG. 2, a portion of an automobile dashboard (instrument panel) 12A is shown, and on one side of the dashboard 12A said unit-one is attached by the bottom side of the housing 3 by using preferably a double-face adhesive tape or suction cups for attachment thereto. An electric cord 13 connects the circuit within the housing 3 to the car-battery circuit through the plug means 14 and the socket 15 located on the dashboard; the socket in this case may be the cigaret-lighter socket that is provided almost in all types of cars. A dry-cell battery may also be used instead of a car battery for this purpose, and in such an event the dry-cell battery may be accommodated in the housing 3, as a self-contained current source.

The unit-two, designated by numeral 2, is snugly mounted on the top section 16 of the car-seat back 17, by means of the curved-end portion 9 between the headrest 18 and the top of the car-seat back 17, with the flat flap section 8 thereof extending down the surface of the seat back 17, whereby it can make a close contact with the back of a driver seated on the seat 19 during driving. The unit-two can also be mounted at the hinge section 20 between the car seat 19 and upwardly projecting seat back 17, whereby the flat portion 8 extends upward over the seat back 17, as shown by the broken lines in FIG. 2; the device operates effectively in both positions, that is, with the flap 8 extending downward, as shown by solid lines, or extending upward, as shown by the broken lines. In both cases, the stimuli from these keep-awake devices, the cylindrical plug 10 or fusiform wand 27, whichever is used in the curved end 9, are transmitted with the same intensity and sensed by the driver with the same effectiveness, since the character of the stimuli transmitted to the spinal cord is the same.

In FIG. 3, the electric circuit section 22 receives an energizing current from the battery 21 through the double-wire cord 13 and plug 14, which enters into jack 15, usually contained in the dashboard of almost all cars as a receptacle for a cigaret lighter. As mentioned above, the system can also be made self-sufficient by including in the housing 3 one or two dry cells, in which case the unit-one can be dismounted when desired from the dashboard and operated together with unit-two at locations outside of a car, such as at home, on a boat, or in a camper, when relaxation of tired muscles is needed. The circuit section 22 contains two branch circuits 23 and 24, the latter having therein means 25 for producing a recurrent flow of current, such means being either a thermostatic-type flasher, a motorized contactor-type interrupter, or a flashing lamp of reasonably high current-carrying capacity to be able to energize the unit-two electrical mechanism therein, since ordinary miniature flashing lamps do not carry enough current to operate unit-two device, especially after the current passes through the variable resistor coil 26. The motorized contactor-type interrupter consist of a motor having a rotating shaft with a contactor thereon that opens and closes the circuit 24 once every other second or faster as desired.

Figure 5:
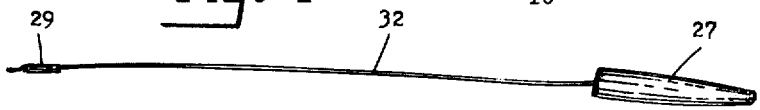
FIG. 5 is a perspective view of the fusiform wand with an electric cord having an electric plug at the end thereof for connection to the electric circuit thereof.
Figure 6:
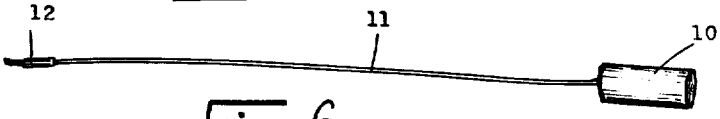
FIG. 6 is the perspective view of the cylindrical plug that is permanently attached to the curved portion of the driver-alerting device.

FIG. 5 shows a modified embodiment of FIG. 6, and contains a fusiform wand 27, operating in the same manner as the cylindrical plug 10. The fusiform wand 27 is used with the vibrating unit 28 whose curved portion 29 is tubularly hollow, into which the fusiform wand 27 is inserted snugly, so that when it is energized by the current flowing thereinto from the electric circuit 22 through the variable resistor 4 and jack 6 or jack 7, plug 29, and cord 32, the stimuli therefrom (from fusiform wand) are conducted to the flat vibrating portion 28 of the alert-sustaining unit 31. When it is desired to use the fusiform wand 27 as a massaging means on the body, such as on the neck, face, shoulder, chest, or legs, the fusiform wand 27 can be easily removed (by just pulling it out the tubular section) and used at the driver's convenience; thus, the fusiform wand serves a double purpose.

Figure 7:
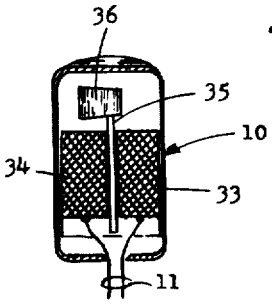
FIG. 7 is the view of the axial cross section of the cylindrical plug, said plug also having been incorporated in the fusiform wand.

The axial cross-sectional veiw of cylindrical plug 10 is shown in FIG. 7, in which numeral 33 designates a housing contaning a motor 34, a motor shaft 35, at one end of which is attached a mass or weight 36, which when cross-sectioned would resemble a miniature pear configuration, with the heavier or larger portion thereof extending out radially so that when said shaft 35 rotates by means of said motor 34 the heavier or larger portion produces an unbalance in the shaft rotation. This unbalance causes the motor 34 to operate in an undulatory manner. Since the motor 34 is intimately attached to housing 33, the undulatory motion of the motor 34 causes the housing 33 to undulate. When the undulations are recurrent, as produced by means of said current interrupter 25, which recurrently interrupts the current therethrough, the housing 33 pulsates in addition to the undulations. The forces, undulations and pulsations, acting upon each other in quadrature, produce an external stimulus to recurrently urge the person leaning against the metal flap section 2 or 28 to stay awake by the sensation of recurrent forward thrusts, as long as the device is in operation.

Figure 8:
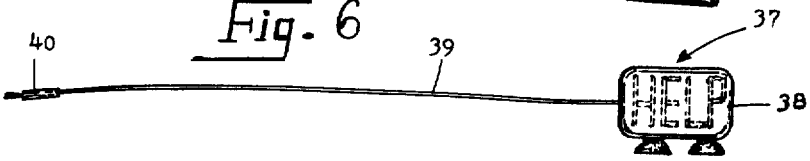
FIG. 8 shows a perspective view of a light signalling device adapted to be attached to one of the electric outlets of the electric circuit shown in FIG. 3.

FIG. 8 represents a road emergency-alerting device having one side open and a face plate comprising a dark plastic sheet with letters HELP die-cut therethrough and backed by a red plastic sheet. The plastic sheets are illuminated by an electric lamp from behind in the housing 38 so that when the device is in operation, the word HELP shows clearly up to several hundred feet. When the switch 5 is moved to position 41, the red light flashes recurrently. This device is used when there is an engine or tire trouble, whereupon the driver pulls the car to the skirt of the road and turns on the HELP flasher to alert other drivers or police in the area that he needs help, which may also be due to a physical disorder requiring medical aid. The HELP device receives energizing current from the electric circuit section 22 through the cord 39 and plug 40, which is insertable into one of the jacks 6 or 7, whichever is available.

Figure 9:
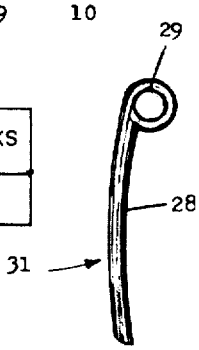
FIG. 9 is the isolated view of the flat springy metal with its curved section and is shown without the cylindrical plug or the fusiform wand that is accommodated in the curved section thereof.
Figure 4:
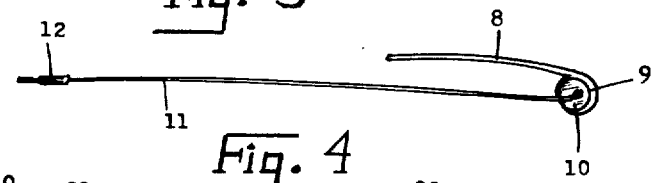
FIG. 4 is one view of the module for keeping the driver awake and alert during driving a car.

In operation of the system, when the driver begins to feel drowsy during his travel, he turns on the switch 5 from its normally neutral position, as shown in FIG. 3, to position 41, and inserts the plug 12 into either jack 6 or 7, whichever is available, whereupon a pulsative motion of undulations are produced in the cylindrical plug member 10 or 27 in unit-two, and the driver senses these undulations and selects an intensity of undulation, by means of the current-control means 4, that is comfortable yet sufficiently stimulative to keep him awake and alert during his driving. When the driver stops driving and desires to relax his tired muscles, he may switch the control means 5 to position 42, a position opposite to position 41; these positions are designated on the housing 1 during manufacture of the device. At this position, the sensation the driver receives from unit-two is very soothing, and he may adjust, as he desires, the current-control means 4 to feel a suitable intensity of undulations, whereby he may even fall asleep by the soothing effect of the vibrations transmitted to his spinal cord. In the event the unit-two comprises the structure shown in FIG. 9 and the fusiform wand has been mounted therein, he may remove the fusiform wand 27 and pass it over the tired or achy muscles to receive local relaxation, The disclosure of the invention described hereinabove represents the preferred embodiments of the invention; however, variations thereof, in the form, construction, and arrangement of the various component parts thereof together with modified applications of the invention are possible without departing from the spirit and scope of the appended claims, and I intend to use such variations as I deem necessary.

I claim:

1. A device for preventing dozing while driving a car, comprising: a first means having a housing adapted to be attached to the dashboard of an automobile and a second means adapted to be mounted on the upwardly projecting back of a driver's seat and having an integral extension therefrom for abutment with the driver's back when he is seated on said seat, said first means and said second means being in electrical connection theretogether by means of an electric conductor; said first means having therein an electrical circuit energizable from an electric current source therein, electric outlets disposed on the wall of the housing of said first means and connected to said electrical circuit, which is provided therein with branched circuit sections having a current-channeling means to permit selection of a current from said branched circuit sections, and a current-intensity control means in electrically series relation with said current-channeling means to adjust the intensity of current flow therethrough from either of said branched circuit sections to said electric outlets; one of said branched circuit sections having therein means to produce a recurrent flow of current therethrough and when in electrical contact with said current-channeling means a recurrent flow of current therethrough is transmitted to said second means though one of said electric outlets and said electric conductor, and when said current-channeling means is in electrical connection with the other of said branched circuit sections an uninterrupted flow of current passes therethrough to said second means through one of said electric outlets and said electric conductor; means disposed in said second means to receive a recurrent flow of current from one of said branched circuit sections and to produce in said second means pulsative undulations, the vibratory effect of which is transmitted through the integral extension of said second means to the back of a driver, seated in the driver's seat, for preventing him from dozing while driving; and, when said uninterrupted flow of current is transmitted to said second means through the circuit path abovedescribed it produces therein undulations which are variable in intensity by means of said current-intensity control means, the vibratory effect of said undulations being transmitted by the integral extension of said second means to the driver for producing relaxation in his body tired from driving, when he stops his car to rest.

2. A device for preventing dozing while driving a car as described in claim 1, wherein said first means adapted to be attached to the dashboard of an automobile is a modular electrical device with a rectangular housing having an adhesive means at the bottom section thereof for attachment of said housing to a part of the dashboard easily accessible to the driver, said housing having therein an electrical means energized by a source of current therein and adapted to produce electric pulses in said electrical means, and electric outlets and a control means disposed on said housing and connected to said electrical means, with said control means adapted to adjust the intensity of said electric pulses and to transmit them to an external device through said electric outlets.

3. A device for preventing dozing while driving a car as defined in claim 1, wherein said second means connected to said first means through an electric conductor is an article of manufacture having a tubular section with an extension of flat springy metal projecting at right angles to the axis of said tubular section, said tubular section is adapted to be mounted on the back of a driver's seat and further adapted to secure in the tubular hollow thereof an electric module having therein an electric rotary means to receive electrical signals from said first means through said electric conductor and to convert said electrical signals into mechanical motions, which are conducted through said extension of flat springy metal to a driver seated in said driver's seat to stimulate him, with his back in abutment with said extension of flat springy metal.

4. A device for preventing dozing while driving a car as defined in claim 3, wherein said article of manufacture is an elongated arcuate flap of plastic material, with one end thereof formed into a cylindrical configuration which being hollow therethrough, a cylindrical member having therein an electric means and adapted to be snugly accommodated within the hollow section of said cylindrical configuration is disposed therein; said electric means in said cylindrical member having therein means adapted to receive an electric current from the first means for producing gyratory motion in said cylindrical member and for conducting said gyratory motion to said elongated arcuate flap.

5. A device for preventing dozing while driving a car as defined in claim 1, wherein said electrical circuit disposed in said first means comprises an electric connector means for receiving a current from an electric battery to energize said electrical circuit, a control means to adjust the current from said electric battery to said electrical circuit, a double-channel circuit with one channel acting as a jumper and the other channel having therein means for repetitively starting and stopping the flow of current therethrough and being in series connection with a switch means disposed in said electrical circuit to function as a currentchanneling means and to turn on and off the current from said electric battery; said current-control means for adjsuting the amount of current flow through said electrical circuit is connected in series relation with said switch means, and current outlets from said electrical circuit for transmitting a current therethrough to the second means of said device.

6. A device for preventing dozing while driving a car as defined in claim 5, wherein said current outlets from said electrical circuit are telephone-type jacks mounted in the housing wall of the first means and are connected in parallel theretogether and in series relation with the current control means and with the electric battery supplying a current to said electrical circuit.

7. A device for preventing dozing while driving a car as defined in claim 1, wherein said second means is provided with an elongated means integrally formed thereon and receives pulsed electric current from said first means through a detachable electric cord connected therebetween, to transform said pulsed current into a mechanically vibratory motion and to transfer said motion to a driver, seated on a driver's seat, through said means integrally formed on said second means which is positioned on the driver's seat in a manner whereby said means integrally formed on said second means extends along the back of the seat for abutment with the back of said driver.

8. A device for preventing dozing while driving a car as defined in claim 1, wherein said means to produce a recurrent flow of current in one of said branched circuit sections is a thermostatic-type flasher for periodically opening and closing the electrical circuit disposed in the first means.

9. The means to produce a recurrent flow of current in one of said branched circuit sections connected in series with a current-channeling means as described in claim 1 is a motorized contactor-type current interrupter.

10. The cylindrical means disposed in the hollow of said cylindrical configuration of said article of manufacture as defined in claim 4 is a fusiform vibratory member detachably disposed in the hollow of said cylindrical configuration and is provided therein with a gyratory electric mechanism; said fusiform vibratory wand has an electric cord connected to said gyratory electric mechanism and extends therefrom to become detachably connected to said first means to receive an electric current therefrom to energize said gyratory electric mechanism.

11. A device for preventing dozing while driving a car as described in claim 1, wherein said first means comprises a housing for including therein an electrical circuit which receives and energizing current from an electric battery source, and has in the electrical circuit thereof a current control means, a current switching means disposed in the wall of said housing, and current outlet means disposed thereon in series connection with said current control means and said current switching means; said housing is provided with means adapted to attach said housing on a part of an automobile interior that is readily accessible to the driver seated in the driver's seat; said electrical circuit having means therein adapted to process the current received thereby into a recurrently flowing current and to transmit said recurrently flowing current to the second means through said current outlet means; said second means comprises an elongated metal flap with a tubular portion formed integrally thereon at one end thereof and positioned at right angles to the axis of said elongated metal flap and is adapted to be mounted on the upper portion of the back of a driver's seat, means with a rotary means disposed therein and adapted to be accommodated within the tubular portion of said metal flap; said rotary means having an electric conductor with means detachably connectable to the current outlet means of said first means to receive a current therefrom for operating said rotary means to produce gyrative undulation, the vibratory effect of which is conducted to said elongated metal flap extending fromsaid second means mounted on the upper portion of the back of a driver's seat, to transfer said vibratory effect to the back of a driver sitted in said driver's seat, with his back in contiguous relation to said elongated metal flap.

12. A device for preventing dozing while driving a car as described in claim 1, wherein said device is provided with an electrical signalling means operable by the current from the electrical circuit included in the first means of said device, said electrical signalling means comprises a housing with means adapted to attach said housing to any part of a car readily visible to outside observers, an electric light source disposed in said housing and connected to an elongated electric cord with the terminal end thereof adapted to be detachably connected to the first means of said device to receive an energizing current from the electrical circuit disposed therein; said housing having an opening in one side thereof and a face plate disposed therein, said face plate comprising a red plastic sheet in contiguity with a black plastic sheet with letters HELP die-cut in said black plastic sheet, whereby when said electric light source is energized by a current from said first means the face plate becomes illuminated from behind thereof so that the work HELP is visible externally to several hundred feet away from said electric signaling means.

13. A device for preventing dozing while driving a car as described in claim 11, wherein said second means having a rotary means adapted to produce gyratory undulations therein is mounted between the driver's seat and the back of the seat adjacent the hinged part thereof, with the tubular portion of the elongated metal flap disposed therebetween, and with said elongated metal flap extending upward along the back of said driver's seat for transmitting gyratory-motion stimuli from said second means through said elongated metal flap to the driver's back in contiguity therewith to keep him awake and alert while driving the car.

14. A device for preventing dozing while driving a car as described in claim 1, wherein said device comprises two discrete electrical members, a first member and a second member, electrically connected theretogether through an electric cord; said first member comprises a housing having therein means adapted to attach said housing to a part of an automobile interior readily accessible to a driver seated in the driver's seat, an electrical mechanism disposed in said housing and adapted to receive for energization thereof an electric current from the battery of said automobile, an electrical control means disposed on said housing and electrically connected to said electrical mechanism for adjusting the current flow therethrough, means in electrically series relation with said electrical control means for producing a recurrent flow of current through said electrical mechanism, and means connected in series with said electrical control means to start and stop said recurrent flow of current therethrough, and electric outlet means connected to said electrical mechanism and disposed in the wall of said housing, externally thereto, to transmit a current from said first member to said second member through said electric cord; said second member is an emergency electric signaling means mounted on a part of said automobile, with the signal therefrom visible externally thereof, said second member is provided with a housing having therein an electric light source and a transparent window in one wall thereof, with said transparent window formed into characters displaying an emergency sign; said llight source being adapted to receive said recurrent flow of current for energization thereof from said first member and for producing recurrent emergency signals projecting from said second member.

* * * * *